United States Patent [19]

Herr

[11] 4,052,872

[45] Oct. 11, 1977

[54] STANCHIONS

[75] Inventor: Peter Erwin Herr, Sandton, Transvaal, South Africa

[73] Assignee: Springbok Appointments (Proprietary) Limited, Johannesburg, Transvaal, South Africa

[21] Appl. No.: 636,796

[22] Filed: Dec. 1, 1975

[30] Foreign Application Priority Data

Dec. 3, 1974 South Africa ..... 74/7674

[51] Int. Cl.[2] ..... B21D 22/10

[52] U.S. Cl. ..... 72/62; 72/DIG. 14

[58] Field of Search ..... 72/58, 370, DIG. 31, 72/DIG. 14, 61, 62; 29/421 R

[56] References Cited

FOREIGN PATENT DOCUMENTS 887,002 1/1962 United Kingdom ..... 72/62

*Primary Examiner*—Leon Gilden

*Attorney, Agent, or Firm*—Haseltine, Lake & Waters

[57] ABSTRACT

A method and apparatus for manufacturing a stanchion or tube having at least two integral bulbous portions thereon are disclosed. The method involves defining at least two spaced cavities on the outside of a stanchion tube, the inner surfaces of the cavities being shaped to define the outer contours of the integral bulbous portions of the completed stanchion. A predetermined quantity of flowable and substantially incompressible material within the tube between the inner ends of two oppositely directed rods extending into the tube from the ends thereof, to cause the tube to deform in substantial conformity with the inner surface of the cavities. The process is repeated on any other regions having cavities formed on the outside thereof without firstly removing the rods from the tube.

6 Claims, 4 Drawing Figures

Fig. 3.
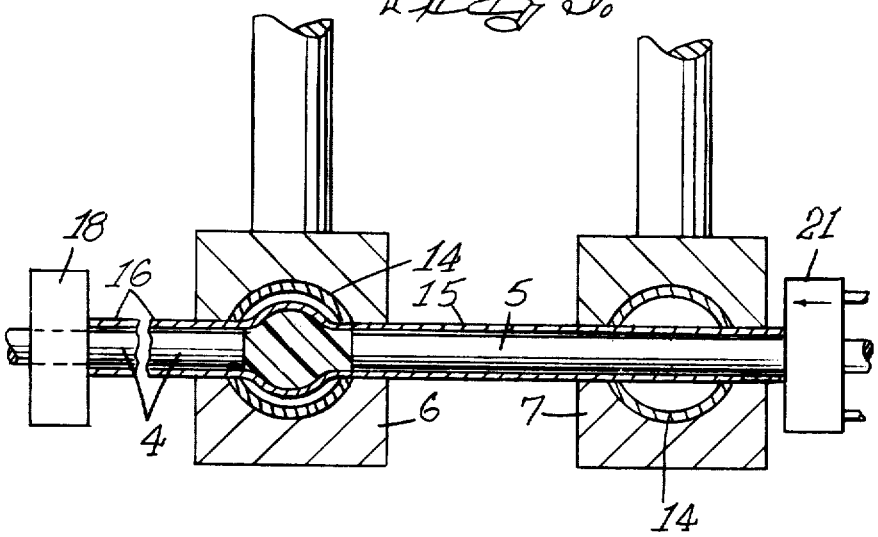
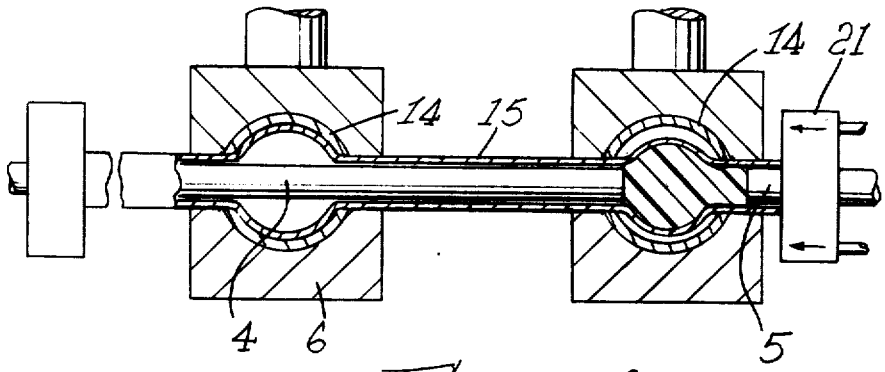
Fig. 4.

STANCHIONS

This invention relates to a method and apparatus for the manufacture of tubular stanchions, and more particularly to stanchions of the type having enlarged regions which are perforated to receive therethrough tubular or other rails of generally the same diameter as the stanchion itself.

Tubular stanchions having, in particular, bulbous portions formed therein to receive hand-rails or the like through holes formed in these bulbous portions have been known for many years, and are in wide use. These stanchions are made in a variety of ways varying from expansion of the tube forming the stanchion in the regions of the bulbous portions to welding operations involving the welding together of separate bulbous portions and tubes.

It is the object of this invention to provide a method and machine whereby stanchions of the above type may be easily made.

In accordance with this invention there is provided a method of manufacturing a stanchion or tube having at least two integral bulbous portions thereon comprising the steps of:

a. providing at least two spaced cavities on the outside of a stanchion tube, the inner surfaces of the cavities being shaped to define the outer contours of the integral bulbous portions of the completed stanchion;

b. compressing a predetermined quantity of deformable or flowable and substantially incompressible material within the tube between the inner ends of two oppositely directed rods extending into the tube from the ends thereof, this first compression being effected in the region of one of said cavities to cause the tube to deform into substantial conformity with the inner surface of the cavity;

c. releasing the compressive force between the rod ends;

d. withdrawing the rod passing completely through a cavity such that its end is at least in the region of the end of the cavity most remote from the already formed bulbous portion;

e. moving the other rod into the region of the other cavity;

f. compressing a predetermined quantity of the above described material in the latter region to cause the walls of the tube to deform into substantial conformity with said other cavity, and g. releasing the compressive force on the rods, and moving them apart at least sufficiently to enable the tube to be removed.

Further features of the invention provide for the cavities to be defined either directly by suitable split die assemblies or by rigid bulbous cover elements which may in turn be constrained in split die assemblies; for the rods to be urged together by means of at least one hydraulic piston and cylinder assembly; for an axially directed compressive force to be applied to the tube during the formation of the integral bulbous formations; and for the predetermined quantity of material to be a slug of elastomeric material.

A still further feature of the invention provides for one end of the stanchion tube to be fixed during formation of the integral bulbous formations in which case the formation nearer the fixed end is formed firstly and any axial compressive force applied to the tube is applied from the end opposite the fixed end.

The invention also provides apparatus for implementing the above defined method, said apparatus comprising a frame, first means for supporting a stanchion tube thereon, second means for locating at least two cavity defining members on a tube supported on the machine, two rods capable of being co-axially aligned and movable towards and away from each other when so aligned, the axis of movement of said rods being substantially coincident with that of a tube supported on the machine, and third means for forcing the rods co-axially together.

Further features of the apparatus provide for said first means to be defined by two or more split die assemblies shaped to define enlarged cavities, said die assemblies acting either directly to form the cavities defined above or to locate and constrain separate cavity defining rigid elements; for the said second means to be adjustably positioned in axial direction on the frame; for stop means to be provided for accurately locating one end of a tube; and for a fourth means to be provided for applying an axially compressive force to a tube located on the machine.

Other features of the apparatus provide for the said third means to comprise at least one hydraulic ram and preferably two (one for each rod) and for one rod to be pivotally movable transverse to its axis to facilitate installation of a tube thereon without increasing the axial path of movement thereof to the entire length of the tube.

The invention will be further described by way of an embodiment thereof reference being made to the accompanying drawings in which:

FIGS. 3 and 4 illustrate the operation of the apparatus in use and thus the process of the invention.

Figure 1:
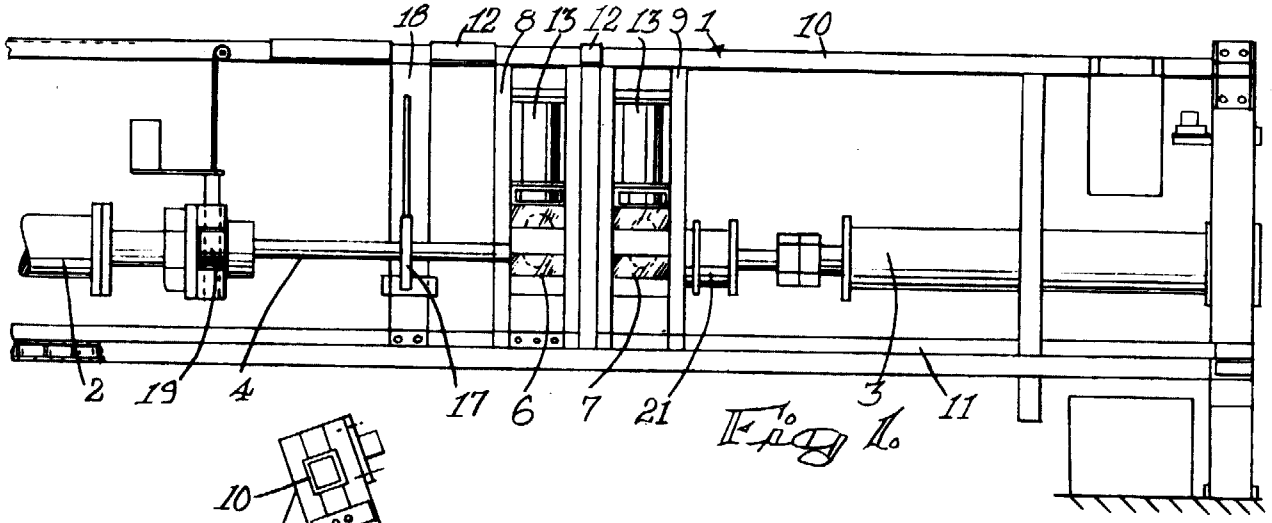
FIG. 1 is a front elevation of apparatus for the manufacture of stanchions.
Figure 2:
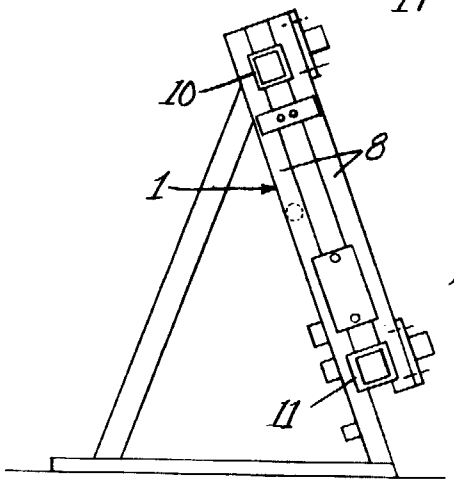
FIG. 2 is an end elevation thereof.

In this embodiment of the invention the apparatus includes a frame 1 supporting a pair of spaced rams 2, 3 from which co-axially aligned piston rods 4, 5 extend toward each other.

The frame also supports two spaced die-pairs 6, 7 operable transversely of the axis of the piston rods. The die-pairs are each shaped to provide cavities adapted to receive substantially spherical hollow elements snugly therein with a tubular stanchion extending out of the die-pairs on each side thereof co-axially with the piston rods.

Preferably the apparatus will be applied to the manufacture of stanchions wherein the tubular stanchion is expanded into pre-formed hollow spherical elements so that should any bursting of the tube occur, the stanchion is not affected. Such elements are those mentioned in the preceding paragraph but it will be understood that the die-pairs may be used to form integral bulbous formations in a stanchion without such pre-formed spherical elements. In this case the die-pairs have cavities of the required final size and shape of the bulbous portions.

The die-pairs are each mounted on a subframe 8, 9 adjustable longitudinally along the length of two horizontal parallel members 10, 11 of the main frame. They are located in required relative positions by means of spacers 12 positioned on at least one of the members 10, 11 of the main frame. Each subframe carries its own hydraulic piston and cylinder assembly 13 to effect opening and closing of its respective die pair.

Further details of the apparatus will, for ease of description, be embodied in the following description of the apparatus in use.

Initially, two hollow spherical elements 14 are located over a stanchion tube 15 which is to form the completed stanchion. The tube is then located co-axially with the piston rods in the apparatus with the spherical elements being located in the die-pairs which are then closed by means of their piston and cylinder assemblies. Before such closure, however, one end 16 of the tube is preferably located accurately at the desired distance from one spherical element which is to be the final distance from this element.

Generally in the manufacture of stanchions two bulbous formations are provided, one roughly midway along the length of the stanchion and one at an end (the upper end in use) thereof. It is therefore most convenient to accurately locate the end 16 of the tube remote from the bulbous formations since a foot plate or other securing means must subsequently be secured thereto. This accurate location of the end 16 is effected by means of a releasable stop 17 provided on a support 18 therefor carried by the transverse members 10, 11 of the main frame. Again positioning of the stop is effected utilizing spacers 12 on the member 10 of the frame.

It will be understood that the piston rod 4 adapted to enter the tube from the end 16 remote from the bulbous formations is not strictly required to be movable from this end 16 of the tube to the nearest of the two bulbous formations. Thus, in order to shorten the stroke required of this piston rod 4 and its associated piston and cylinder assembly as well as to decrease the overall length of the apparatus, this piston rod is provided with a hinge 19 to allow it to swing outwardly. With this arrangement the tube is slid on this piston rod which is then swung back into co-axial alingment with the die-pairs and other piston rod. Once in this condition the apparatus is ready to commence the manufacturing cycle.

Firstly the piston rod 4 nearer the said accurately located end 16 is moved inwardly into the tube to stop approximately opposite the end of the spherical element nearest said end of the tube. The other piston rod 5 is then moved into the tube to compress between itself and the first piston rod an elastomeric slug 20 which in turn causes the tube to bulge outwardly and ultimately into contact with the spherical element held in the die-pair 6. The elastomeric slug is made of a material which will last reasonably well under the compressive forces exerted thereon, and the slug may be a loose piece inserted into the tube at any suitable stage or alternatively, it may be bonded or otherwise secured to either of the piston rods. This step is illustrated in FIG. 3.

During the above operation the tube will shorten somewhat and in order to ensure that the accurately located end is not affected, a clamp may be secured to the tube towards its opposite end this clamp being urged by any suitable means such as a spring or preferably a small hydraulic ram 21 towards the die-pairs to ensure that material required is consumed from that end.

After the one bulbous portion is completed, the piston rod 5 which extended through the second die-pair 7 is withdrawn to a position adjacent the end of the spherical element remote from said accurately located end, and is stopped in this position. The slug is now again tubular in shape and free to move along the tube. The other piston rod is then moved along the tube pushing the slug before it until it is in a position adjacent the nearer end of the other bulbous element and the other bulbous formation is completed as above described utilizing movement of the same piston rod 5 as before. This step is illustrated in FIG. 4.

Both piston rods are then withdrawn from the stanchion which can be finished off as required. In the case described where the one piston rod is hinged this is effected after swinging the rod outwardly. Also, means are provided for lifting the stanchion from the die-pairs to release it therefrom.

It will be understood that the above sequence of operational steps is easily automated with the use of limit switches activating control valves in the hydraulic or pneumatic system as the case may be. The arrangement of the control assembly will therefore not be described herein.

Automatic feeding of the stanchion tubes to the above described apparatus may be effected but it is preferable in this instance to make both piston rods movable to an extent such that they are both totally withdrawn from the tube after completion of the formation of the bulbous portions. Also, it will be understood that only one ram is actually required to effect compression of the slug of elastomeric material and thus the other rod could simply be an axially movable rod provided with any suitable means of anchoring it in the required positions and moving it between the three basic positions required, i.e. the withdrawn position and the two positions in which it is required to be to form the two bulbous formations. Furthermore any number of bulbous formations greater than two in a tube may be formed by an analagous process.

Whilst the above description has been directed to the use of elstomeric slugs as the material to be located between the rod ends, other materials are envisaged and are intended to be included in the scope of the invention. Suitable materials are lead which would be recovered by heating the final stanchion to melt the lead; particulate flowable materials such as sand; or even plastics material which, whilst not having elastomeric characteristics can be recovered by a suitably expedient method.

Also, the invention is not only applicable to the manufacture of mild steel stanchions but may be applied particularly to the manufacture of aluminium, brass, copper or other stanchions.

The invention therefore provides a useful and effective process and apparatus for forming a plurality of integral bulbous formations in a stanchion or like tube.

What I claim as new and desire to secure by Letters Patent is:

1. A method of manufacturing a stanchion or tube having at least two integral bulbous portions thereon comprising the steps of:

a. providing at least two spaced fixed split cavities on the outside of a stanchion tube, the inner surfaces of the cavities being shaped to define the outer contours of the integral bulbous portions of the completed stanchion;

b. applying a compressive force to a predetermined quantity of flowable and substantially incompressible material within the tube between the inner ends of two rods extending into the tube from the ends thereof, and one of which rods passes completely through the region of one of the cavities, this first compression being effected in the region of the other of the cavities to cause the tube to deform into substantial conformity with the inner surface of the said other cavity;

c. releasing the compressive force between the rod ends;

d. withdrawing the rod passing completely through the said one cavity such that its end is at least in the region of the end of the said one cavity most remote from the already formed bulbous portion;

e. moving the other rod into the region of the said one cavity;

f. applying a compressive force to a predetermined quantity of flowable and substantially incompressible material in the latter region to cause the walls of the tube to deform into substantial conformity with the said one cavity, and g. releasing the compressive force on the rods and moving them apart at least sufficiently to enable the tube to be removed therefrom after the split cavities are moved apart to an open position.

2. A method as claimed in claim 1 in which the cavities are defined by rigid bulbous elements.

3. A method as claimed in claim 2 in which the bulbous elements are located in split die assemblies during formation of the integral bulbous portions of the tube.

4. A method as claimed in claim 1 in which the rods are urged together to effect compression of the material by means of at least one hydraulic piston and cylinder assembly.

5. A method as claimed in claim 1 in which an axially directed compressive force is applied to the tube during formation of the integral bulbous portions.

6. A method as claimed in claim 1 in which the said material is a slug of elastomeric material.

* * * * *